US008013881B2

(12) United States Patent
Yuda et al.

(10) Patent No.: US 8,013,881 B2
(45) Date of Patent: Sep. 6, 2011

(54) LIQUID EJECTING APPARATUS AND LIQUID EJECTING METHOD

(75) Inventors: Tomohiro Yuda, Minowa-machi (JP); Bunji Ishimoto, Matsumoto (JP); Akito Sato, Matsumoto (JP); Takeshi Tanoue, Matsumoto (JP); Naoki Sudo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 12/384,013

(22) Filed: Mar. 31, 2009

(65) Prior Publication Data

US 2009/0244155 A1 Oct. 1, 2009

(30) Foreign Application Priority Data

Mar. 31, 2008 (JP) ..... 2008-089998

(51) Int. Cl.
*B41J 2/205* (2006.01)
*B41J 2/21* (2006.01)

(52) U.S. Cl. ..... 346/15; 347/43

(58) Field of Classification Search ..... 347/9, 12, 347/13, 15, 19, 40–43
See application file for complete search history.

(56) References Cited

U.S. PATENT DOCUMENTS

| | | | | |
|---|---|---|---|---|
| 6,203,133 | B1 * | 3/2001 | Tanaka et al. | 347/15 |
| 6,491,373 | B1 * | 12/2002 | Fujita et al. | 347/41 |
| 6,843,546 | B2 * | 1/2005 | Nunokawa | 347/15 |
| 2005/0243126 | A1 | 11/2005 | Takahashi et al. | |

FOREIGN PATENT DOCUMENTS

| | | | |
|---|---|---|---|
| EP | 1088669 | A | 9/2000 |
| EP | 1559560 | A | 8/2005 |
| JP | 2007-098682 | | 4/2007 |
| JP | 2007-136889 | | 6/2007 |
| WO | 2006123528 | A | 11/2006 |

OTHER PUBLICATIONS

European Search Report, Feb. 14, 2011.

* cited by examiner

*Primary Examiner* — An H Do
(74) *Attorney, Agent, or Firm* — Nutter McClennen & Fish LLP; John J. Penny, Jr.

(57) ABSTRACT

A liquid ejecting apparatus for forming a multicolored image on a recording medium includes: a printing head for ejecting a plurality of colors; a head driving section that performs a main scanning for moving the printing head in a main scanning direction; a transporting section that transports the recording medium in a sub-scanning direction crossing the main scanning direction; and a dot control section that controls the head driving section and the transporting section so as to form an image on the recording medium by ejecting the liquids on the recording medium from the nozzle while repeatedly performing the main scanning for moving the printing head in the main scanning direction and a sub-scanning for transporting the recording medium in the sub-scanning direction.

8 Claims, 13 Drawing Sheets

LIQUID EJECTING APPARATUS AND LIQUID EJECTING METHOD

The present application claims the priority based on a Japanese Patent Application No. 2008-089998 filed on Mar. 31, 2008, the disclosure of which is hereby incorporated by reference in its entirety.

BACKGROUND

1. Technical Field

The present invention relates to a liquid ejecting apparatus that forms an image on a recording medium by ejecting liquid.

2. Related Art

An ink jet type printer (hereinafter, it is referred to as an ink jet printer) has been used as an example of liquid ejecting apparatuses, which forms an image by scanning a printing head having a plurality of nozzles for forming dots in a main scanning direction, ejecting liquid, and transporting a recording medium in a sub-scanning direction crossing the main scanning direction. The printing head of such an ink jet printer is provided with nozzle arrays, which correspond to respective colors, for ejecting respective color liquids, and is adapted to form each pixel of an image on a recording medium by superposing dots of two or more colors.

JP-A-2007-98682 and JP-A-2007-136889 are examples of related art.

However, a pixel color is varied depending on a dot formation order since the liquids having different colors has different characteristics in density, viscosity, and the like. For example, when a paper is used as a recording medium, a dot firstly formed spreads out in a large area and sinks into the paper. A dot secondly formed is superposed on the dot formed just before, and less spreads than the dot formed just before. Accordingly, the color of the dot previously formed becomes remarkably deeper than the color of the dot subsequently formed.

When printing is performed by using an ink jet printer capable of performing bi-directional printing, the dot formation order is different for each pixel in the forward path and the backward path of scanning of the printing head. For this reason, color unevenness caused by color differences among pixels appears on the image formed on the recording medium. As a result, a problem arises in that image quality of the image formed on the recording medium is deteriorated.

SUMMARY

An advantage of some aspects of the invention is to improve image quality of an image formed by a liquid ejecting apparatus that performs bi-directional printing.

The some aspects of invention have been made to solve at least a part of the problem mentioned above, and can be realized as the following forms or application examples.

Application Example 1

According to an aspect of the invention, a liquid ejecting apparatus for forming a multicolored image on a recording medium includes: a printing head that has at least a first nozzle array for ejecting a liquid of a first color having a first hue, a second nozzle array for ejecting a liquid of a second color having a second hue, and a third nozzle array for ejecting a liquid of a third color having a third hue; a head driving section that performs a main scanning for moving the printing head in a main scanning direction; a transporting section that transports the recording medium in a sub-scanning direction crossing the main scanning direction; and a dot control section that controls the head driving section and the transporting section so as to form an image on the recording medium by ejecting the liquids on the recording medium from the nozzle while repeatedly performing the main scanning for moving the printing head in the main scanning direction and a sub-scanning for transporting the recording medium in the sub-scanning direction. The dot control section controls the printing head so as to alternately form a dot having the first hue and a dot having the second hue and form a dot having the third hue between the dot having the first hue and the dot having the second hue, when forming one predetermined pixel constituting the image.

In accordance with the liquid ejecting apparatus of Application Example 1, when a pixel is formed by using liquids having three hues, the dots of the first hue and the second hue are alternately overlapped with each other, and the dot of the third hue is overlapped between the dots of the first hue and the second hue. By adopting such a configuration, the dots of the first hue, the second hue, and the third hue are mixed with a good balance, and thus difference in color unevenness of pixels can be reduced. As a result, it is possible to improve image quality of the image formed on the recording medium.

In the liquid ejecting apparatus of Application Example 1, it is preferable that the printing head further include a fourth nozzle array for ejecting a liquid of a fourth color that has the first hue and is different from the first color, and a fifth nozzle array for ejecting a liquid of a fifth color that has the second hue and is different from the second color. By adopting such a configuration of the liquid ejecting apparatus of Application Example 1, it is possible to mix the dots of the first, second, and third hues with a good balance even when using six-color liquids.

In the liquid ejecting apparatus of Application Example 1, it is preferable that the fourth color be lighter than the first color, and the fifth color be lighter than the second color, and it is also preferable that the dot control section control the printing head so as to successively form a dot of the fourth color and a dot of the fifth color, successively form a dot of the first color and a dot of the second color, and form a dot of the third color between the dot of the fourth color and the dot of the fifth color or between the dot of the first color and the dot of the second color. In accordance with the liquid ejecting apparatus of Application Example 1, the dots of light colors (fourth color and fifth color) and the dots of dark colors (first color and second color) is formed with a good balance relative to the dot of the third color when a plurality of liquids having mutually different concentrations and plural colors are used. As a result, it is possible to suppress shade unevenness and color unevenness caused in pixels by the overlapping order of the light and dark inks.

In the liquid ejecting apparatus of Application Example 1, it is preferable that the printing head be configured such that the nozzle array of the first hue and the nozzle array of the second hue are alternately provided, the third nozzle array is disposed between the nozzle array of the first hue and the nozzle array of the second hue, and the plurality of nozzles are offset from each other by one-half of a predetermined distance in the sub-scanning direction so as to be arranged in a hound's-tooth form, and it is also preferable that the dot control section form dots in order of the nozzle arrays from the nozzle array arranged downstream in an advancing direction of the printing head, during the main scanning. In accordance with the liquid ejecting apparatus of Application Example 1, since the nozzles are arranged in a hound's-tooth form, dots are ejected in order of nozzle array arrangement from the nozzles arranged downstream in the advancing direction of the main scanning, thereby alternately forming dots of the first and second hues without difficulty. As a result, it is possible to reduce process load of the liquid ejecting apparatus.

In the liquid ejecting apparatus of Application Example 1, it is preferable that the fourth color be lighter than the first color, and the fifth color be lighter than the second color, and it is also preferable that the printing head be configured such that nozzles of the fourth and fifth nozzle arrays are offset by one-half of the predetermined distance from nozzles of the first and second nozzle arrays, respectively. In accordance with the liquid ejecting apparatus of Application Example 1, the light color dots are successively formed, and the dark color dots are successively formed at the time of forming one pixel. As a result, it is possible to suppress shade unevenness caused by the overlapping order of the light and dark inks when using the plurality of liquids having mutually different concentrations and plural colors.

In the liquid ejecting apparatus of Application Example 1, it is preferable that the printing head be configured such that nozzles of the third nozzle array and the nozzles of the fourth and fifth nozzle arrays are offset by one-half of the predetermined distance from nozzles of the first and second nozzle arrays. Color tone variation of the dark color dot is larger than those of other color dots, but color tone variation of the light color dot is smaller than those of other color dots. By adopting such a configuration of the liquid ejecting apparatus of Application Example 1, it is possible to suppress occurrence of color unevenness with high accuracy.

In the liquid ejecting apparatus of Application Example 1, it is preferable that the first color be cyan, the second color be magenta, the third color be yellow, the fourth color be light cyan, and the fifth color be light magenta. In accordance with the liquid ejecting apparatus of Application Example 1, dots of colors other than yellow are formed with a good balance relative to the yellow dot when one predetermined pixel is formed. As a result, it is possible to suppress occurrence of color unevenness with high accuracy.

The above-mentioned various aspects may be appropriately combined or partially omitted to be applied. The above-mentioned aspects of the invention may be realized in various forms such as a liquid ejecting method for the liquid ejecting apparatus, a computer program for causing the liquid ejecting apparatus to eject liquid, and a recording medium having such a computer program readably recorded thereon, other than the above-mentioned configurations of the liquid ejecting apparatus. The above-mentioned aspects can be appropriately applied to any forms. For example, various media such as a flexible disk, a CD-ROM, a DVD-ROM, a magnetic optical disk, an IC card, and a hard disk can be used as the computer-readable recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Example

Figure 1:
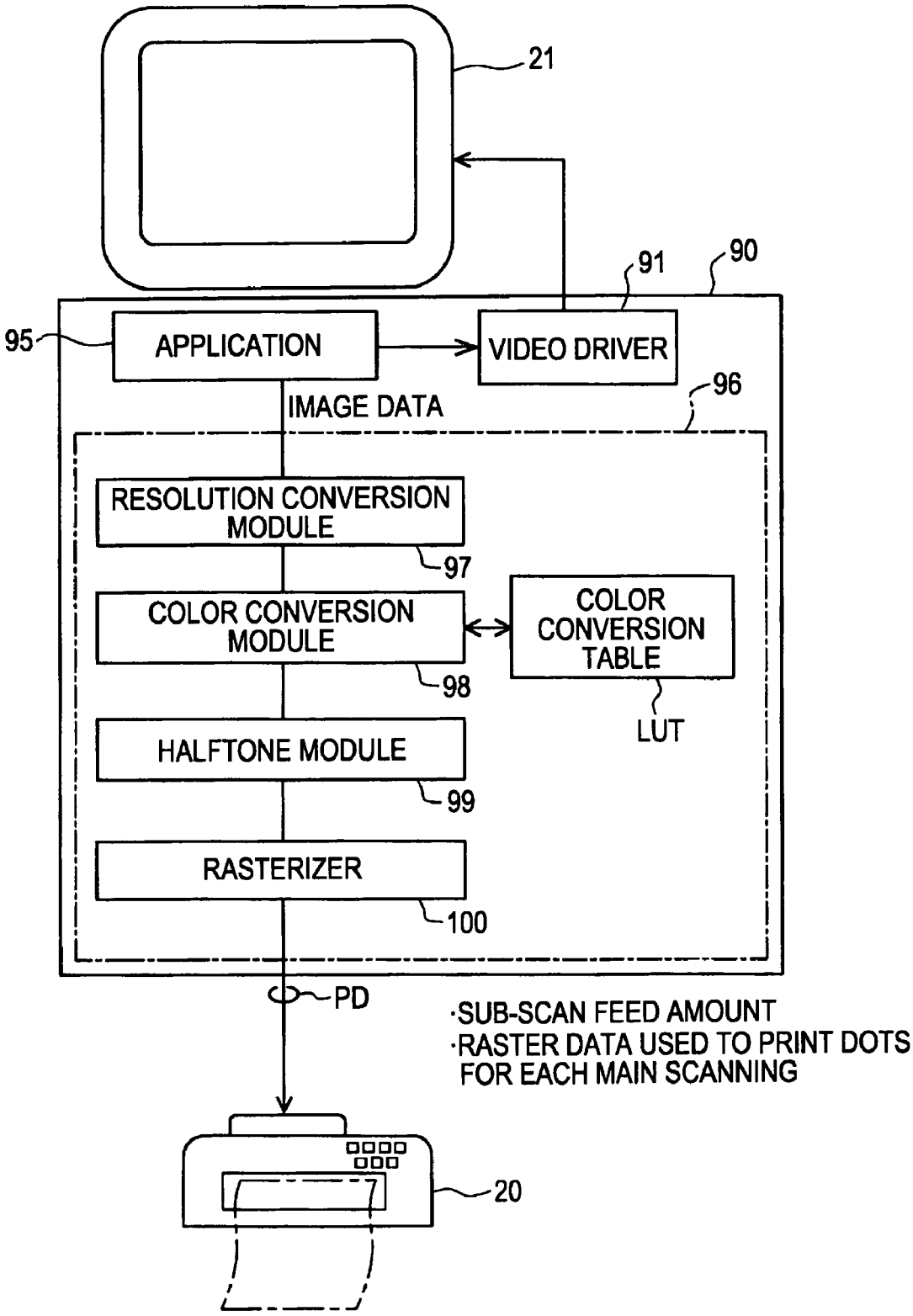
FIG. 1 is a block diagram illustrating a configuration of a printing system according to a first example of the invention.

A1. Configuration of Printing System:

FIG. 1 is a block diagram illustrating a configuration of a printing system according to a first example of the invention. The printing system includes a computer 90 and a color printer 20. The combination of printer 20 and computer 90 can be called a "liquid ejecting apparatus" in a broad sense. Alternatively, a program, which is installed on the printer 20 and the computer 90 so as to function as a printer driver, may be called the liquid ejecting apparatus in a broad sense. A printer that has a printer driver function may be called the liquid ejecting apparatus.

In the computer 90, an application program 95 is carried out under a predetermined operating system. The operating system contains a video driver 91 or a printer driver 96 incorporated therein, and the application 95 outputs print data PD to be transmitted to the printer 20 with the aid of such a driver. The application program 95 having a function of image retouch and the like performs a desired process on a target image, and displays an image on a CRT 21 with the aid of the video driver 91.

When the application program 95 issues a print command, the printer driver 96 of the computer 90 receives image data from the application program 95, and converts the data into the print data PD supplied to the printer 20. In the example in FIG. 4, the printer driver 96 is provided with a resolution conversion module 97, a color conversion module 98, a half-tone module 99, a rasterizer 100, and a color conversion look-up table LUT.

The resolution conversion module 97 has a function of converting a resolution (that is, the number of pixels per unit length) of color image data formed by the application program 95 into a print resolution. The resolution-converted image data is image information still composed of three color components of RGB. The color conversion module 98 converts the RGB image data into multi-tone data of a plurality of ink colors usable in the printer 20 for each pixel, while referring to the color conversion look-up table LUT.

The color-converted multi-tone data has, for example, tone depth of 256 gray scales. The halftone module 99 creates halftone image data by executing a so-called halftone process. The halftone image data is rearranged in an order of data to be transmitted to the printer 20 by the rasterizer 100, and is output as final print data PD. The print data PD includes raster data representing dot printing states at each main scanning and data representing a sub-scan feed amount.

The printer driver 96 corresponds to a program for realizing a function of creating the print data PD. That is, the printer driver 96 corresponds to "dot control section" described in claims. The program for realizing the function of the printer driver 96 is supplied in a state where it is recorded on a computer-readable recording medium. Various media such as a flexible disk, a CD-ROM, a magnetic optical disk, an IC card, a ROM cartridge, a punch card, a printed matter on which codes including a bar-code are printed, and an internal storage device (memory such as RAM or ROM) and an external storage device of computer can be used as the recording medium.

Figure 2:
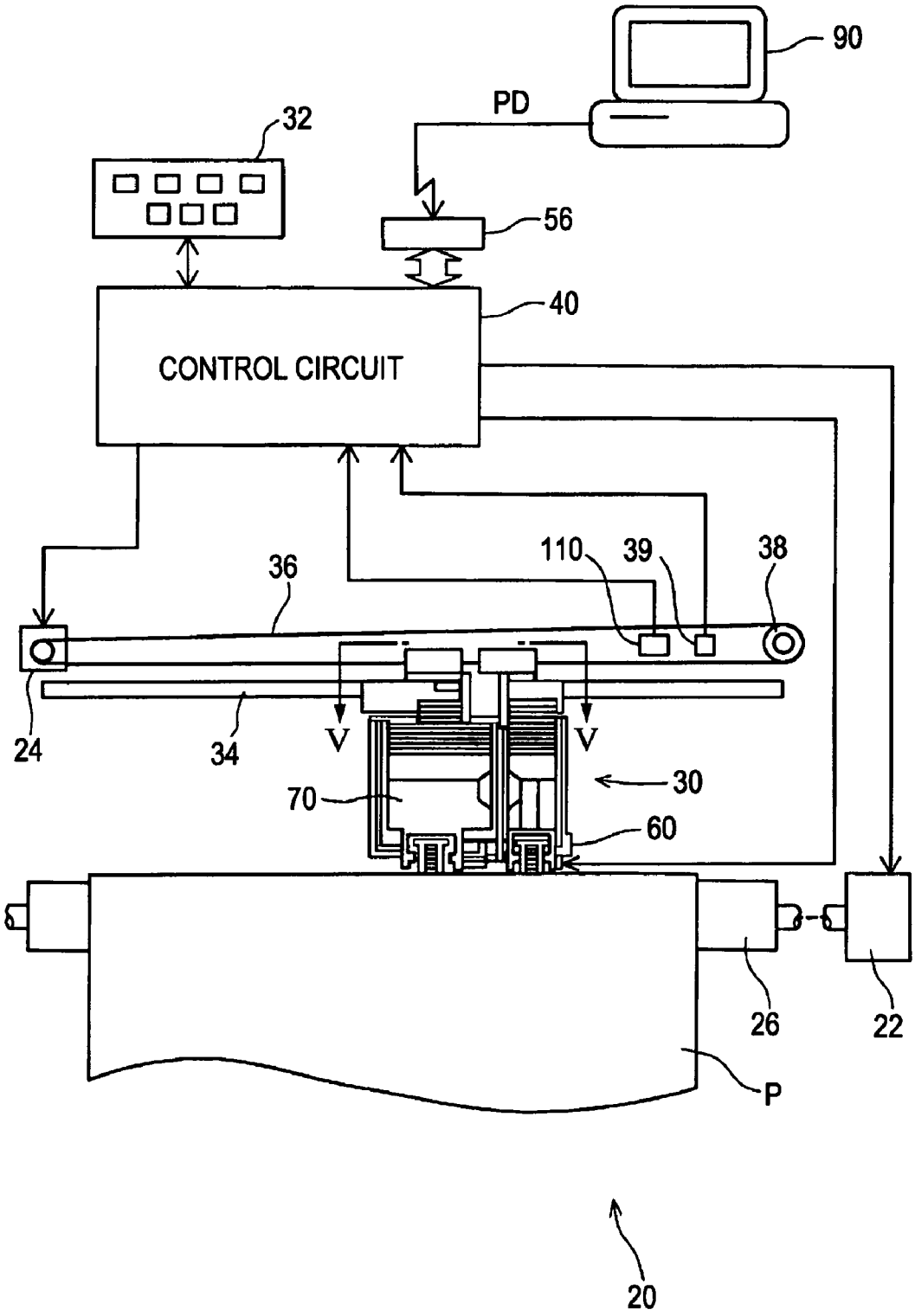
FIG. 2 is a schematic configuration diagram of a printer 20 according to the first example.

FIG. 2 is a schematic configuration diagram of the printer 20 according to the first example. The printer 20 has a sub-scan moving mechanism that transports a printing paper P in the sub-scanning direction by the paper feeding motor 22, a main-scan moving mechanism that reciprocates a carriage 30 in a axial direction (main scanning direction) of a platen 26 by the means of a carriage motor 24, a head driving mechanism that controls dot formation and ink ejection by driving a printing head section 60 mounted on the carriage 30, and a control circuit 40 that exchanges signals among the paper feeding motor 22, the carriage motor 24, the printing head section 60, and an operation panel 32. The control circuit 40 is connected to the computer 90 via a connector 56.

The sub-scan moving mechanism that transports a printing paper P has a gear train (not shown)that transfers rotation of the paper feeding motor 22 to the platen 26 and a printing paper transport roller (not shown). The main-scan moving mechanism that reciprocates the carriage 30 has a sliding shaft 34 that is installed in parallel to an axis of the platen 26 to slidably hold the carriage 30, a pulley 38 that tenses an endless driving belt 36 from the carriage motor 24, and a position sensor 39 that detects the original position of the carriage 30.

Figure 3:
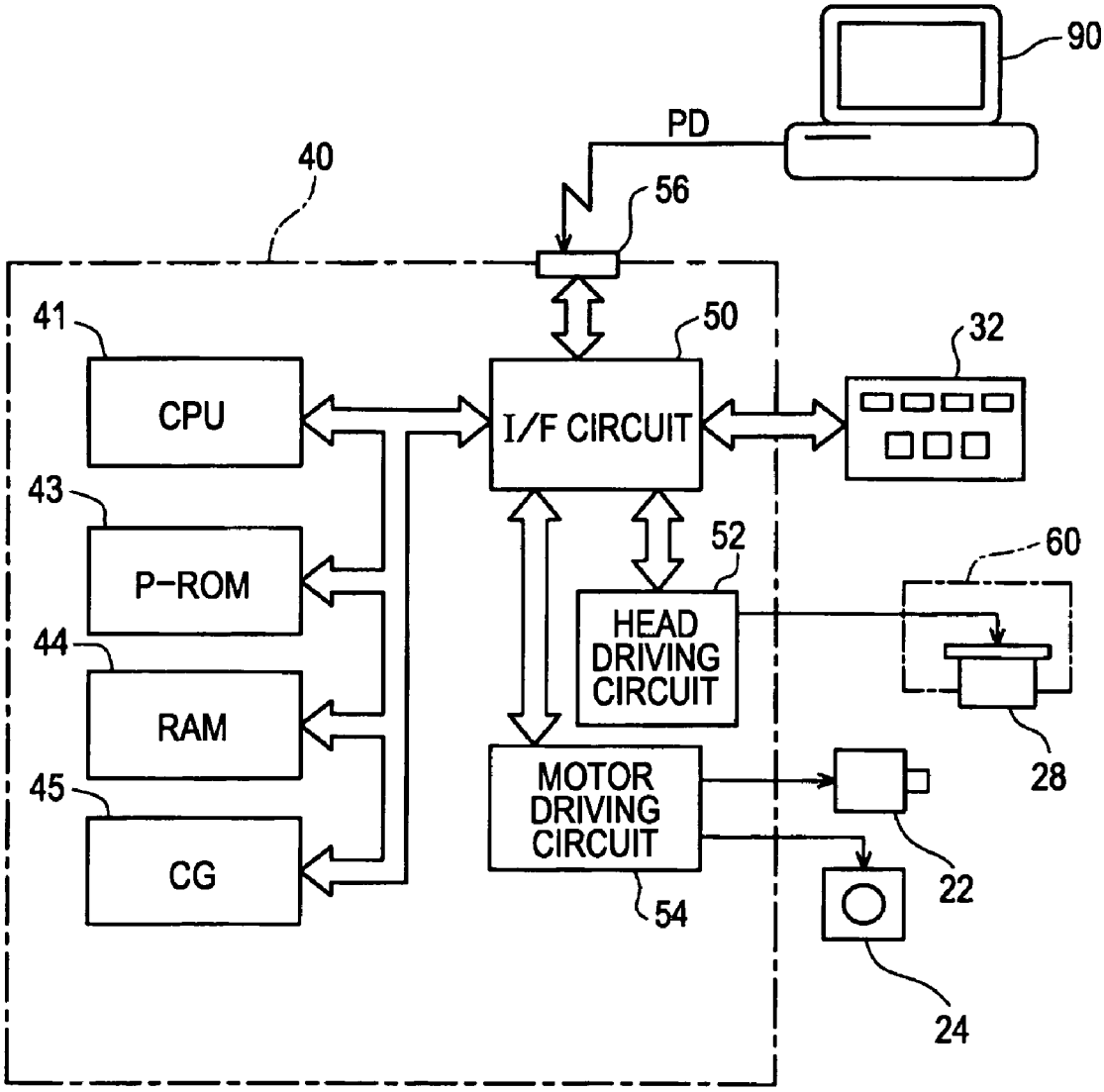
FIG. 3 is a block diagram illustrating the printer 20 by focusing attention on a control circuit 40 according to the first example.

FIG. 3 is a block diagram illustrating the printer 20 by focusing attention on the control circuit 40 according to the first example. The control circuit 40 is configured as an arithmetic logic operation circuit that has a CPU 41, a programmable ROM (PROM) 43, a RAM 44, and a character generator (CG) 45 containing dot matrices of characters. The control circuit 40 further includes a I/F circuit 50 that creates a dedicated interface with external motors and the like, a head drive circuit 52 that is connected to the I/F circuit 50 and is adapted to eject ink by driving the printing head unit 60, and a motor driving circuit 54 that drives the paper feeding motor 22 and the carriage motor 24. The I/F circuit 50 has a parallel interface circuit built therein and is capable of receiving print data PD from the computer 90 via the connector 56. The color printer 20 prints images in accordance with the print data PD. The RAM 44 functions as a buffer memory for the temporary storage of raster data.

The printing head unit 60 has a printing head 28 and is capable of mounting ink cartridges. The printing head unit 60 can be mounted on the color printer 20 and removed as a single component. In other words, the printing head unit 60 is replaced when the printing head 28 needs to be replaced.

Figure 4:
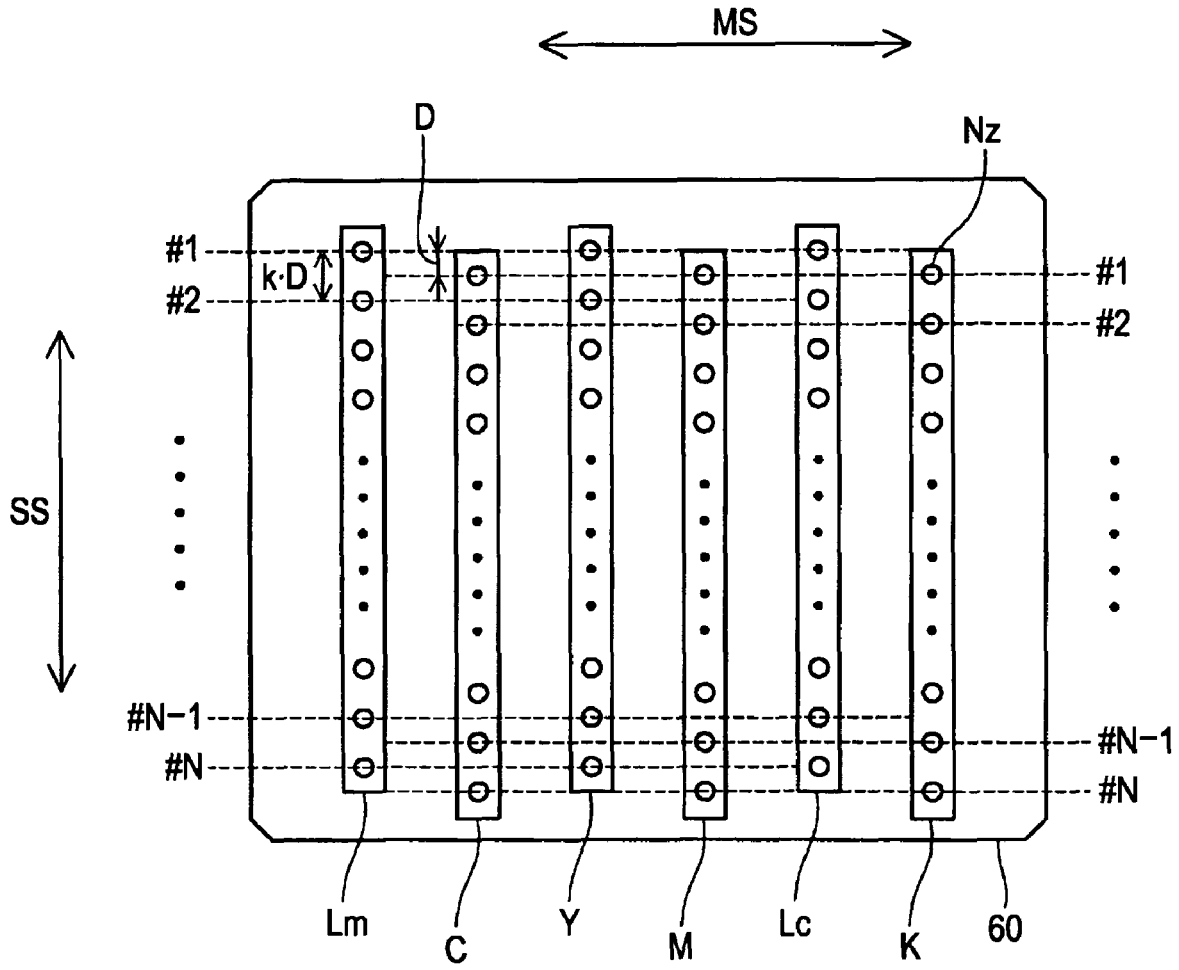
FIG. 4 is an explanatory diagram illustrating nozzle arrangement on the lower surface of a printing head 28 according to the first example.

FIG. 4 is an explanatory diagram illustrating nozzle arrangement on the lower surface of the printing head 28 according to the first example. The lower surface of the printing head 28 is provided with, in order from the right side of the drawing: a nozzle array K for ejecting black ink, a nozzle array C for ejecting cyan ink, a nozzle array Lc for ejecting light cyan ink, a nozzle array M for ejecting magenta ink, a ink nozzle array Lm for ejecting light magenta ink, and a nozzle array Y for ejecting yellow ink.

The plurality of nozzles in each nozzle array are arranged at a constant nozzle pitch k·D in a sub-scanning direction SS. Here, k is an integer, and D is a pitch (it is referred to as a "dot pitch") that corresponds to print resolution in the sub-scanning direction. In the specification, it can be said that "the nozzle pitch is k dots". The "dot" as unit is defined as a dot pitch of print resolution. The "dot" as unit thereof is also used in the sub-scan feed amount. In the first example, since the nozzle pitch k·D is 180 dpi and k=2, the dot pitch in a feeding direction is 360 dpi.

In the printing head 28, the plurality of nozzles is arranged in a hound's-tooth form by adopting a configuration in which nozzle positions of each nozzle array are offset by one-half of the nozzle pitch from nozzle positions of the adjacent nozzle array in the sub-scanning direction. In the example, nozzle positions of the nozzle array K, the nozzle array C, and the nozzle array M are common with respect to the sub-scanning direction. Accordingly, when dots are formed while the printing head 28 is moved in the main scanning direction by the carriage 30, nozzles of the nozzle array K, the nozzle array C, and the nozzle array M are operable to form dots on the same positions on the printing paper P during a single scanning. Likewise, the nozzle positions of the nozzle array Lc, the nozzle array Lm, the nozzle array Y are also common with respect to the sub-scanning direction, and thus are operable to form dots on the same positions on the printing paper P during a single scanning.

Each nozzle is provided with a piezoelectric element (not shown) as a driving element for driving the nozzle to discharge ink droplets. During printing, ink droplets are discharged from each nozzle while the print head 28 reciprocates in the main scanning direction MS. The nozzles of each nozzle array are numbered as #1, #2 . . . #N in order from the upper side. In the first example, N=180. In the first example, the motion of the printing head 28 from the left side toward the right side of the drawing is called forward motion, and the motion of the printing head 28 from the right side toward the left side of the drawing is called a backward motion. The printing head 28 ejects dots in order of the nozzle arrays from the nozzles of the nozzle array arranged downstream in the advancing direction thereof at each of the forward and backward motions of the reciprocating motion.

In the color printer 20 having the hardware configuration mentioned above, the carriage 30 is reciprocated by the carriage motor 24 while the printing paper P is transported by the paper feeding motor 22, simultaneously the piezoelectric elements of the printing head 28 is driven to eject color ink droplets, and then ink dots are formed, thereby forming a multi-color multi-tone image on the printing paper P.

Figure 5A:
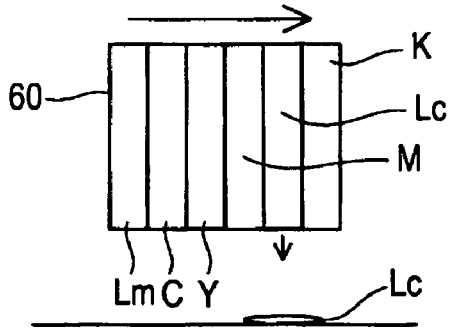
FIGS. 5A to 5E are diagrams explaining dot formation order of the printing head 28 according to the first example.
Figure 5B:
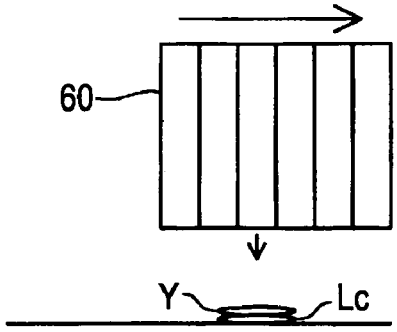
Figure 5C:
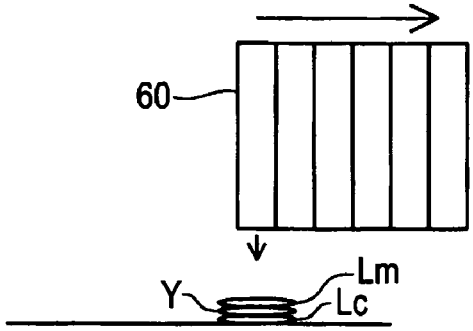
Figure 5D:
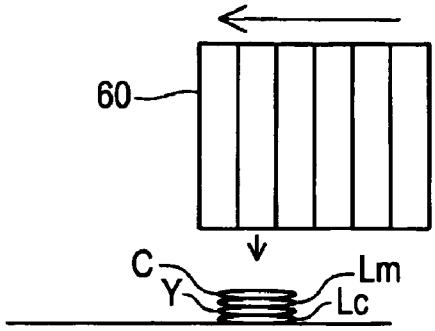
Figure 5E:
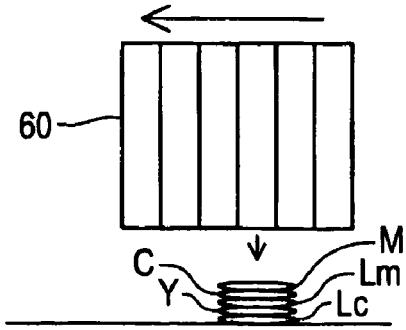

A2. Arrangement of Nozzle Array and Dot Formation Order:

FIGS. 5A to 5E are diagrams explaining dot formation order of the printing head 28 according to the first example. FIGS. 5A to 5E show sectional views taken along line V-V of FIG. 2. FIGS. 5A to 5C show dots ejected during forward motion, and FIGS. 5D to 5E show dots ejected during backward motion, when one pixel is formed. FIGS. 5A to 5E show an example in which a pixel is formed on a predetermined position on the printing paper P, and show the pixel in which a dot of the nozzle array Lc is initially formed. The printing head 28 forms a dot of light cyan on the predetermined position of the printing paper P by use of the nozzle array Lc, subsequently forms a dot of yellow by use of the nozzle array Y, and then a dot of light magenta by use of the nozzle array Lm, during the forward motion, as shown in FIGS. 5A to 5C. Next, the printing head 28 forms a dot of cyan upon the dot of light magenta by use of the nozzle array C, and then forms a dot of magenta by use of the nozzle array M, during the backward motion. In this manner, a new color is created by mutually mixing dots formed by the nozzle arrays of the printing head 28, thereby forming one pixel. The above-mentioned example shows the pixel in which the dot of the nozzle array Lc is initially formed. In the example, the dots can be ejected from the nozzles and a pixel adjacent to the pixel, which is formed according to the above-mentioned example, in the sub-scanning direction is formed by forming dots in order of cyan, magenta, light cyan, yellow, and light magenta, in both directions of the reciprocating motion during the main scanning.

A3. Printing Method:

In the ink jet type printer for performing bi-directional printing, color tones and shades of pixels become different from each other when the dot forming orders of the pixels are different. For example, a yellow ink has a characteristic that makes the color of the previously printed ink deeper, and thus difference in color tone increases between a pixel on which the yellow ink is printed first and a pixel on which the yellow ink is printed at the last. When the dots having the same hue are successively formed, the color tone of hue of the previously formed dot becomes deeper, and thus difference in color tone increases between pixels of which previously formed dots have different hues. At the time of forming one pixel, when a liquid having a shade is used and a dot of a high-concentrated liquid is formed first, a concentration of the dot is dominant, and thus a clear image having a high concentration is formed. When a dot of a high-concentrated liquid is formed after a dot of a low-concentrated liquid is formed, the high-concentrated dot is deeply sink into the vicinity of the dot of the low-concentrated liquid, and a smooth and uniform image having an appropriate concentration is formed. In other words, shade unevenness occurs even when the same image is printed. The printer 20 of the first example is configured to form dots so as to suppress difference in color tone in consideration of hues and shades of inks.

In the first example, dots of the cyan-based inks and dots of the magenta-based inks are alternately formed, and dots of the yellow ink are formed between the dots of the cyan-based inks and the dots of the magenta-based inks, in each pixel printed by the printing head 28. When the yellow ink is regarded as a reference, in all the pixels, dark inks (cyan ink, magenta ink) are printed in order of dark ink->dark ink->yellow ink, or yellow ink->dark ink->dark ink, and light inks (light cyan ink, light magenta ink) are printed in order of light ink->yellow ink->light ink. As a result, in one pixel, printing is performed in order of dark ink->yellow ink->dark ink, and in another pixel, printing is performed in order of dark ink->dark ink->yellow ink. As described above, the printing order of the dark and light inks relative to the yellow ink does not changed. Accordingly, all the pixels constituting an image are formed by printing the dark inks and the light inks with a good balance relative to the yellow ink. In this manner, inks of different hues are alternately printed, and dark and light inks are printed with a good balance relative to yellow ink, thereby suppressing difference in color tone between pixels. Hereinafter, the dot formation order according to the first example will be described in detail.

Figure 6:
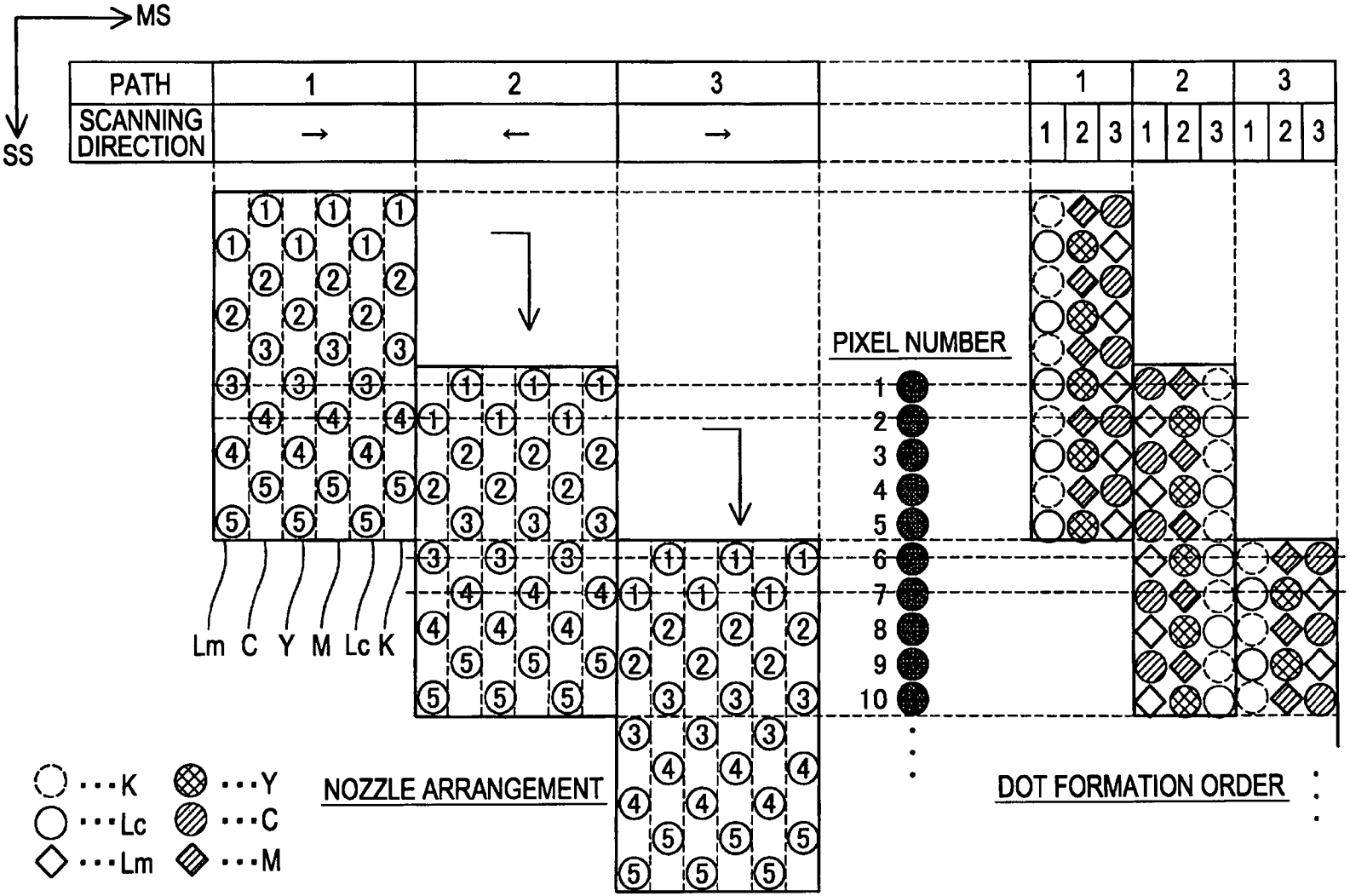
FIG. 6 is a diagram explaining a printing method according to the first example.

FIG. 6 is a diagram explaining a printing method according to the first example. The "path N" denotes an Nth scanning of a printing head (N is an integer not less than 1), in FIG. 6. FIG. 6 shows an example of a printing using the printing head 28 of which each nozzle array has five nozzles. In addition, FIG. 6 shows the case of using 5 nozzles, but actually each nozzle array of the printing head 28 has 180 nozzles in the first example. The circle marks denote nozzles, and the numerals in the circle marks denote nozzle numbers of the nozzle arrays, in FIG. 6. The nozzle number is given in ascending order in the sub-scanning direction. The "dot formation order" is an order in which dots are formed in the pixel. In the "dot formation order", the diagonally hatched circle marks denote dots of the nozzle array C of cyan ink, the blank circle marks denote dots of the nozzle array Lc of light cyan ink, the diagonally hatched diamond marks denote dots of the nozzle array M of magenta ink, the blank diamond marks denotes dots of the nozzle array Lm of light magenta ink, and the cross-hatched circle marks denote dots of the nozzle array Y of yellow ink.

The "pixel numbers" denote positions of pixels formed by the printing head 28. The hatched circle marks adjacent to the pixel numbers denote pixels formed by the printing head 28, and correspond to pixel numbers, respectively. The pixel denotes a state in which each raster line is cut by a width corresponding to one pixel in the sub-scanning direction. That is, the pixel numbers coincide with numbers of the raster lines obtained when the raster lines are numbered in an ascending order in the sub-scanning direction. For example, a pixel having a pixel number of 1 is an example of the pixel formed on the first raster line. The "path" denotes how many times scanning is performed, and the "sequence number" denotes a sequence number of dot formation at each scanning. For example, when the path is "1", the dot having a sequence number of 2 denotes a second-formed dot at the first scanning. The arrows noted in the item of "scanning direction" denote scanning directions. For example, the first scanning shows that the printing head 28 is scanned from the left side of the drawing toward the right side. The black ink K is not printed in an area in which the black ink K is not used in a color image, and thus is denoted by the blank circle mark. However, the color image may have an area in which the black ink K is used together with color inks such as a yellow ink Y, a magenta ink M, and a cyan ink C, in some color areas. In this case, since the color of the ink K is maintained regardless of the printing order of the ink K, the printing order of the black ink K have almost no influence on the color thereof.

In the path 1, since the printing head 28 performs the forward motion, dots are formed in each pixel position in order of the nozzle array K, which is arranged downstream in an advancing direction (the right side in FIG. 6) thereof, the nozzle array Lc, the nozzle array M, the nozzle array Y, the nozzle array C, and the nozzle array Lm. The printer 20 according to the examples transports the printing paper P by one-half of the dot pitch (print resolution) in the sub-scanning direction whenever each single scanning is terminated. Therefore, in the path 1, dots are not ejected from the nozzles of nozzle Nos. 1 and 2 of the nozzle array C and the nozzle array M and the nozzles of nozzle Nos. 1, 2, and 3 of the nozzle array Lc, the nozzle array Y, and the nozzle array Lm. Consequently, dots are formed on positions of pixel Nos. 1 to 5 in the path 1.

When the process of the path 1 is terminated, the printer 20 transports the printing paper P by one-half of the dot pitch in the sub-scanning direction. Consequently, in FIG. 6, the printing paper P is transported by a distance corresponding to five dots in the sub-scanning direction.

In the path 2, since the printing head 28 performs the backward motion, dots are formed in each pixel position in order of the nozzle array Lm, which is arranged downstream in an advancing direction (the left side in FIG. 6) thereof, the nozzle array C, the nozzle array Y, the nozzle array M, and the nozzle array Lm. Dots are formed on positions of pixel Nos. 1 to 10 in the path 2. When the process of the path 2 is terminated, the printer 20 transports the printing paper P by one-half of the dot pitch in the sub-scanning direction.

In the path 3, since the printing head 28 performs the forward motion, dots are formed in each pixel position in order of the nozzle array Lm, which is arranged downstream in the advancing direction (the right side in FIG. 6) thereof, the nozzle array C, the nozzle array Y, the nozzle array M, and the nozzle array Lm, similarly to the process in the path 1.

The dot formation orders of pixels printed in the paths 1 and 2 of the printing head 28 will be described with reference to an example of pixels formed on positions of pixel Nos. 1 and 2. Dots of a light cyan ink, a yellow ink, and a light magenta ink are formed in this order, on the position of pixel No. 1 in the path 1. Dots of a cyan ink and a magenta ink are formed in this order, on the light magenta ink previously formed on the position of pixel No. 1 in the path 2. Dots are formed on the positions of pixel Nos. 3 and 5 in the same order as the position of pixel No. 1, thereby forming pixels thereon.

Dots of the magenta ink and the cyan ink are formed in this order, on the position of pixel No. 2 in the path 1, and dots of the light magenta ink, the yellow ink, and the light cyan ink are formed on the cyan ink previously formed on the position of pixel No. 2 in path 2. Dots are formed on the position of pixel No. 4 in the same order as the position of pixel No. 2, thereby forming a pixel thereon.

Hereinafter, the dot formation orders of pixels printed in the paths 2 and 3 will be described with reference to an example of pixels formed on positions of pixel Nos. 6 and 7. Dots ejected during the backward motion of the printing head are previously formed, and dots ejected during the forward motion are formed on the dots ejected during the backward motion in the paths 2 and 3.

Dots of the light magenta ink, the yellow ink, and the light cyan ink are formed in this order, on the position of pixel No. 6 in the path 2. Dots of the magenta ink and the cyan ink are formed in this order, on the light cyan ink previously formed on the position of pixel No. 6 in the path 3. Dots are formed on the positions of pixel, Nos. 8 and 10 in the same order as the position of pixel No. 6, thereby forming pixels thereon.

Dots of the cyan ink and the magenta ink are formed in this order, on the position of pixel No. 7 in the path 2. Dots of the light cyan ink, the yellow ink, and the light magenta ink are formed in this order, on the magenta ink previously formed on the position of pixel No. 7 in the path 3. Dots are formed on the positions of pixel No. 9 in the same order as the position of pixel No. 7, thereby forming pixels thereon.

As shown in FIG. 6, dots of cyan-based inks and dots of magenta-based inks are alternately formed, and dots of yellow ink are printed between the dots of the cyan-based inks and the dots of the magenta-based inks, in each pixel.

A cyan ink and a magenta ink as dark inks are printed in order of magenta ink->cyan ink->yellow ink, or in order of yellow ink->cyan ink->magenta ink, in the pixel formed in the paths 1 and 2. In other words, the pixels formed in the paths 1 and 2 denote pixels in which the dot of the nozzle array Lc is formed first. Likewise, the dark inks are printed in order of dark ink->dark ink->yellow ink, or yellow ink->dark ink->dark ink, in the pixels formed in the paths 2 and 3.

By contrast, when the yellow ink is regarded as a reference, the light cyan ink and the light magenta ink as light inks are printed in order of light magenta ink->yellow ink->light cyan ink, or in order of light cyan ink->yellow ink->light magenta ink, in the pixel formed in the paths 1 and 2 as shown in FIG. 6. In other words, the light inks are printed in order of light ink->yellow ink->light ink in the pixel formed in the paths 1 and 2, and likewise, light inks are printed in order of light ink->yellow ink->light ink in the pixel formed in the paths 2 and 3.

As described above, the dark inks are successively printed before or after the yellow ink, and the light inks are printed before and after the yellow ink, in each raster line. By adopting such a configuration, the dark inks and the light inks are printed with a good balance relative to the yellow ink, and difference in color tone of each pixel is reduced. In the example, hereinafter, the pixel in which a dark ink is printed first is referred to as a first type pixel, and the pixel in which a light ink is printed first is referred to as a second type pixel. For example, in FIG. 6, the pixels formed on positions of odd pixel numbers is the first type pixel, and the pixel formed on positions of even pixel numbers is the second type pixel.

Figure 7:
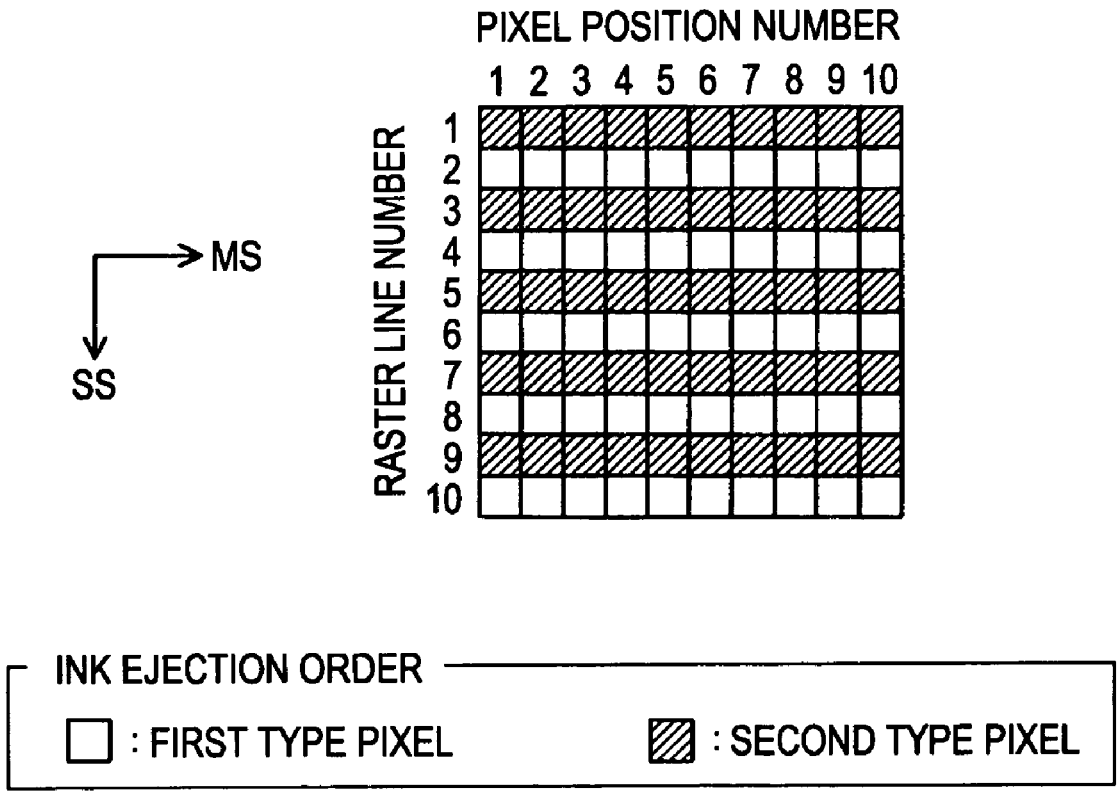
FIG. 7 is an explanatory diagram illustrating an example of pixel arrangement according to the first example.

FIG. 7 is an explanatory diagram illustrating an example of pixel arrangement according to the first example. An image IM is an example of an image printed by the printer 20, and is an image represented by 100 pixels of 10×10. The first type pixel is indicated by hatching in FIG. 7. The pixels of the raster lines of odd line numbers are formed of the first type pixels, and the pixels of the raster lines of even line numbers are formed of the second type pixels, as shown in FIG. 7. Accordingly, the image IM includes the raster lines (hereinafter, in this example, it is referred to as the first type raster line), which are formed of only the first type pixels, and each raster line (hereinafter, in this example, it is referred to as the second type raster line), which is formed of only the second type pixels, in which the first and second raster lines are alternately arranged in the sub-scanning direction as shown in FIG. 7. By adopting such a configuration in which the first and second type raster lines are periodically repeated as described above, it is possible to suppress color unevenness in the entire image.

In the configuration of the printer 20 of the first example as described above, when an image is formed by using plural type inks, the cyan-based inks and the magenta-based inks are alternately printed on the printing paper P, and the yellow ink is printed between the cyan-based ink and the magenta-based ink, thereby forming pixels constituting the image. Accordingly, extremely deep red and blue tones can be suppressed in each pixel, and color unevenness of the image formed on the printing paper can be suppressed. As a result, it is possible to improve image quality of the image.

In the configuration of the printer 20 of the first example, the cyan ink and the magenta ink as dark inks are successively printed relative to the yellow ink, and the light magenta ink and the light cyan ink as light inks are printed between the yellow inks, in an image area formed by the scanning performed in order of forward motion->backward motion and an image area formed by the scanning performed in order of backward motion->forward motion. Accordingly, it is possible to reduce difference in color unevenness, that is, difference in color tone caused in the plurality of image areas. As a result, it is possible to improve image quality of the image.

In the configuration of the printer 20 of the first example, the yellow ink is printed in a path different from the path of the cyan ink and the magenta ink as dark inks. Since the yellow ink has a strong influence on color variation of the dark inks, the previously printed color tone becomes deeper when the yellow ink is printed close to the dark inks. Since the yellow ink and the dark inks are printed in different paths, time difference occurs between printing timings of the yellow ink and the dark inks, and thereby the previously printed ink is slightly dried. Thus, since the influence on color tone variation is reduced, it is possible to suppress color reversal of pixels, and it is possible to improve image quality of an image.

In the configuration of the printer 20 of the first example, the nozzle positions of each nozzle array are offset from the nozzle positions of the adjacent nozzle array in the sub-scanning direction such that the plurality of nozzles is arranged in a hound's-tooth form, and the nozzle arrays corresponding to the inks is arranged in order of black ink, cyan ink, light cyan ink, magenta ink, yellow ink, magenta ink, light magenta ink in the advancing direction of the forward motion of the printing head. The cyan-based inks and the magenta-based inks can be alternately printed, and the yellow ink can be printed between the light cyan ink and the light magenta ink, by adopting such a simple configuration in which dots are formed in order of the nozzle arrays from the nozzles of the nozzle array arranged downstream in the advancing direction of the main scanning of the printing head. As a result, it is possible to easily realize the control of dot formation order and a production of the printing head.

B. Second Example

Figure 8:
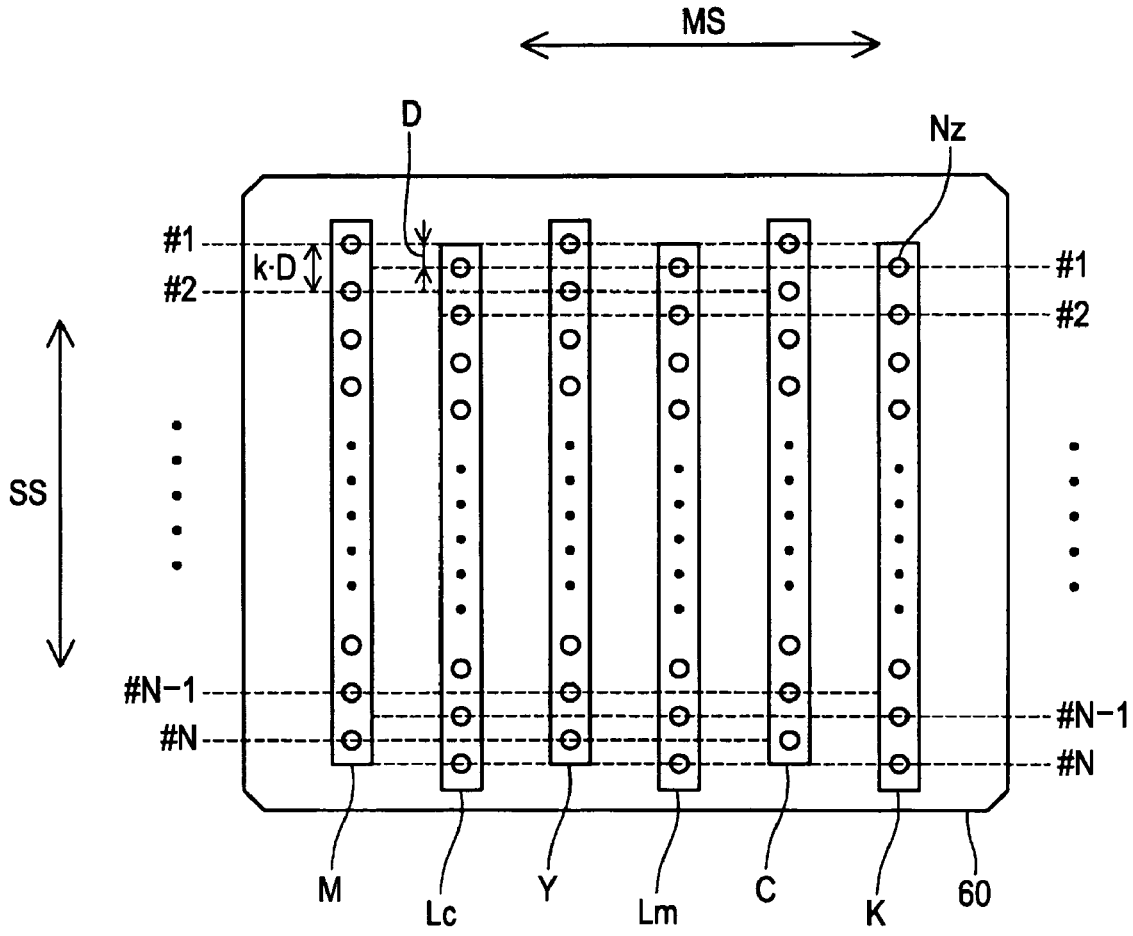
FIG. 8 is an explanatory diagram illustrating nozzle arrangement on the lower surface of the printing head 28 according to a second example.

B1. Arrangement of Nozzle Arrays:

FIG. 8 is an explanatory diagram illustrating nozzle arrangement on the lower surface of the printing head 28 according to a second example. The lower surface of the printing head 28 is provided with, in order from the right side of the drawing: a nozzle array K for ejecting black ink, a nozzle array C for ejecting dark cyan ink, a ink nozzle array Lm for ejecting light magenta ink, a nozzle array Y for ejecting yellow ink, a nozzle array Lc for ejecting light cyan ink, and a nozzle array M for ejecting dark magenta ink. An arrangement distance of the nozzles and an offset between the adjacent nozzle arrays are the same as those of FIG. 4.

Figure 9:
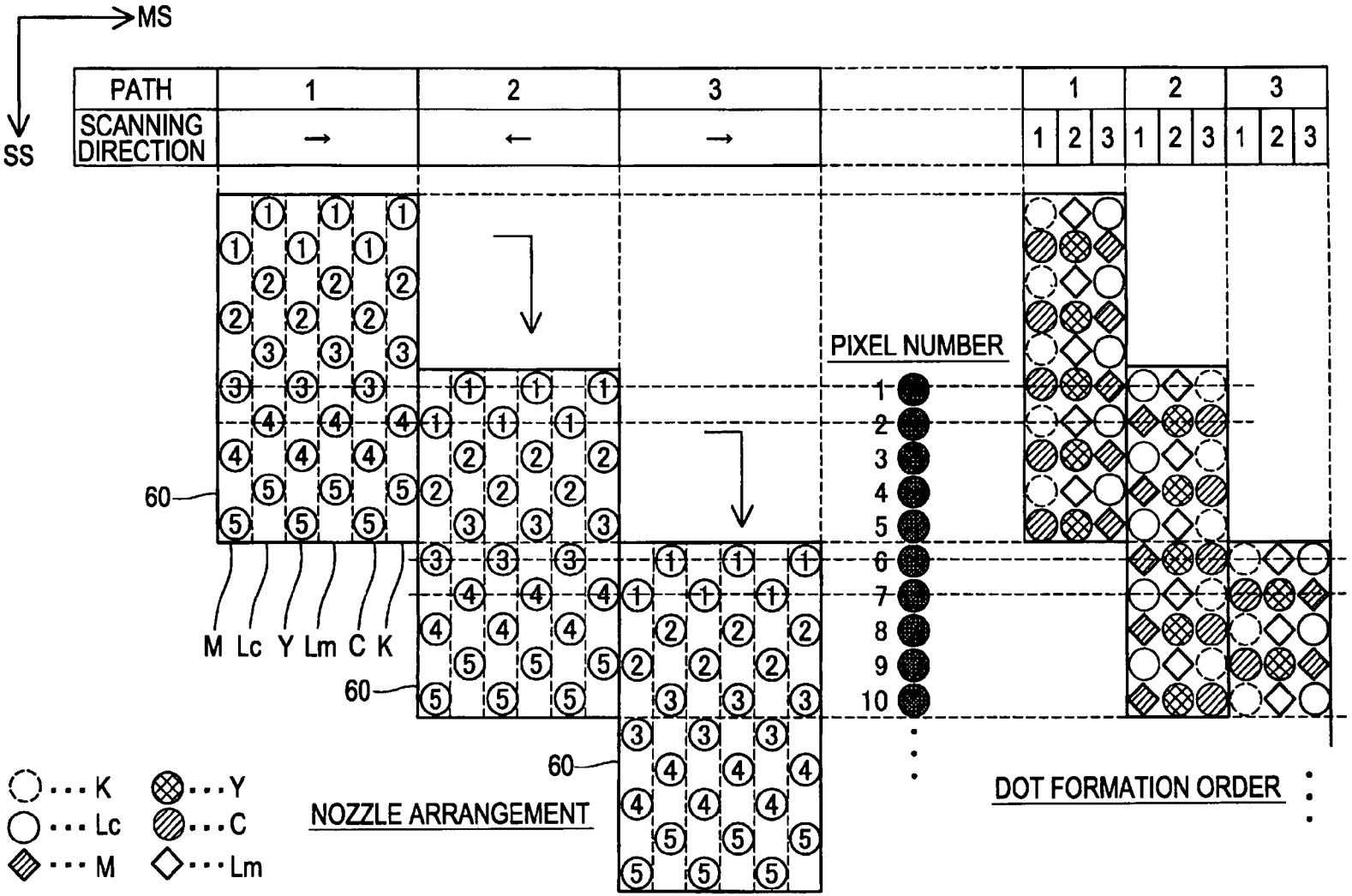
FIG. 9 is a diagram explaining a printing method according to the second example.

B2. Printing Method:

FIG. 9 is a diagram explaining a printing method according to the second example. Definition of the signs and marks in FIG. 9 is the same as those in FIG. 6. The printing head 28 forms dots in each pixel position in order of the nozzle array K, which is arranged downstream in an advancing direction (the right side in FIG. 9) thereof, the nozzle array C, the nozzle array Lm, the nozzle array Y, the nozzle array Lc, and the nozzle array M, similarly to the first example.

The dot formation orders in the paths 1 and 2 of the printing head 28 will be described with reference to an example of pixels formed on positions of pixel Nos. 1 and 2. Dots of the cyan ink, the yellow ink, the magenta ink, the light cyan ink, and the light magenta ink are formed in this order, on the position of pixel No. 1, thereby forming a pixel thereon. Dots of the light magenta ink, the light cyan ink, the magenta ink, the yellow ink, and the cyan ink are formed in this order, on the position of pixel No. 2, thereby forming a pixel thereon. Dots are formed on the positions of pixel Nos. 3 and 5 in the same order as the position of pixel No. 1, thereby forming pixels thereon. Dots are formed on the position of pixel No. 4 in the same order as the position of pixel No. 2, thereby forming a pixel thereon.

Next, the dot formation orders of pixels printed in the paths 2 and 3 will be described with reference to an example of pixels formed on positions of pixel Nos. 6 and 7. Dots of the magenta ink, the yellow ink, the cyan ink, the light magenta ink, and the light cyan ink are formed in this order, on the position of pixel No. 6. Dots of the light cyan ink, the light magenta ink, the cyan ink, the yellow ink, and the magenta ink are formed in this order, on the position of pixel No. 7. Dots are formed on the positions of pixel Nos. 8 and 10 in the same order as the position of pixel No. 6, thereby forming pixels thereon. Dots are formed on the position of pixel No. 9 in the same order as the position of pixel No. 7, thereby forming a pixel thereon.

The dots of cyan-based inks and the dots of magenta-based inks are alternately formed, and the dots of yellow ink are formed between the dots of the cyan-based inks and the dots of the magenta-based inks, in each pixel printed by the printing head 28, similarly to the first example. As a result, the dots of the yellow ink are formed between the dots of cyan-based inks and the dots of the magenta-based inks.

Next, printing orders of light and dark inks and a yellow ink will be described. In the first example, when the yellow ink is regarded as a reference, the cyan ink and the magenta ink as dark inks are printed in order of cyan ink->yellow ink->magenta ink, or in order of magenta ink->yellow ink->cyan ink, in the pixel formed in the paths 1 and 2, as shown in FIG. 9. In other words, the dark inks are printed in order of dark ink->yellow ink->dark ink, in the pixels formed in the paths 1 and 2. Likewise, the dark inks are printed in order of dark ink->yellow ink->dark ink, in the pixels formed in the paths 2 and 3.

By contrast, when the yellow ink is regarded as a reference, the light cyan ink and the light magenta ink as light inks are printed in order of light magenta ink->light cyan ink->yellow ink, or in order of yellow ink->light cyan ink->light magenta ink, in the pixel formed in the paths 1 and 2 as shown in FIG. 9. In other words, the light inks are printed in order of light ink->light ink->yellow ink, or in order of yellow ink->light ink->light ink, in the pixel formed in the paths 1 and 2. Likewise, light inks are printed in order of light ink->light ink->yellow ink, or in order of yellow ink->light ink->light ink, in the pixel formed in the paths 2 and 3.

As described above, the dark inks are printed before and after the yellow ink, and the light inks are successively printed before or after the yellow ink, in each raster line, regardless of whether the dark inks are printed first or the light inks are printed first. In this manner, it is possible to suppress color reversal and color unevenness by printing the dark inks and the light inks with a good balance relative to the yellow ink.

C. Third Example

Figure 10:
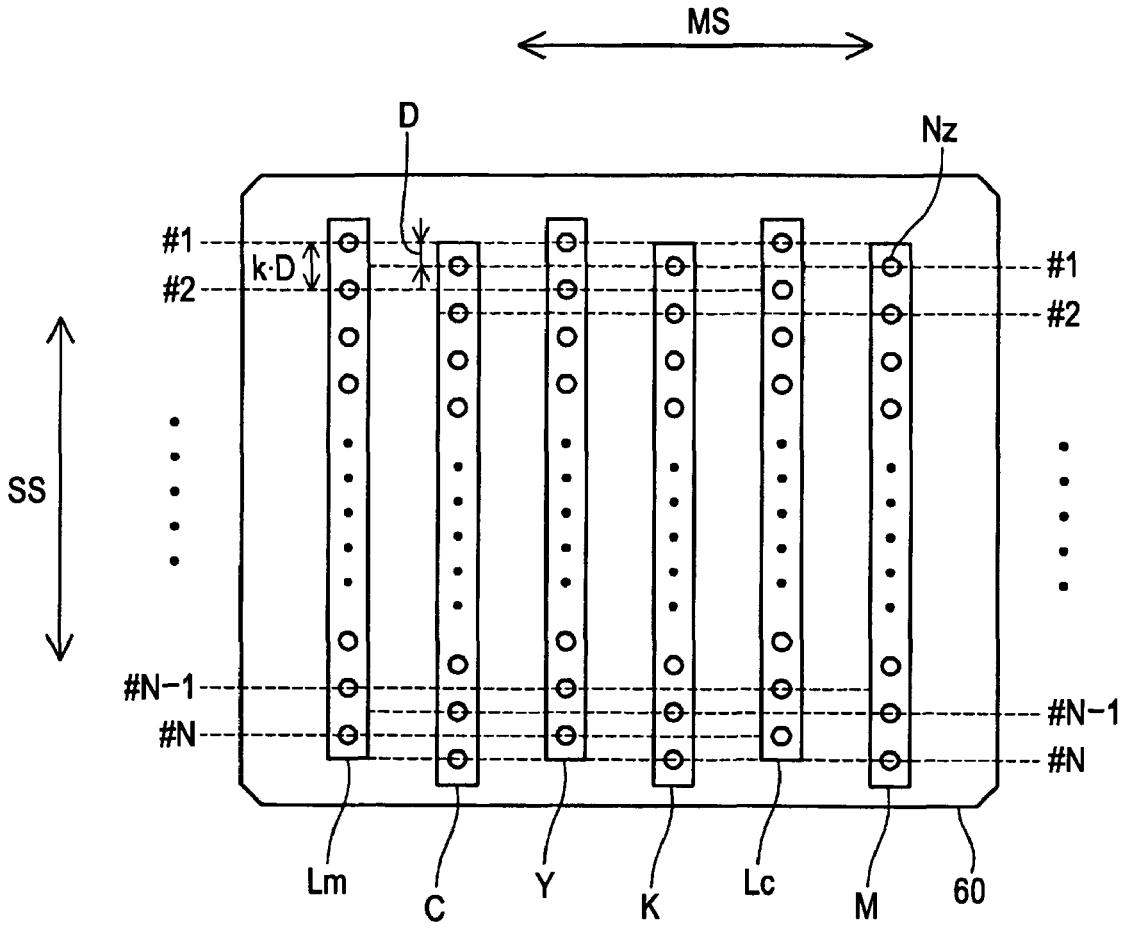
FIG. 10 is an explanatory diagram illustrating nozzle arrangement on the lower surface of the printing head 28 according to a third example.

C1. Arrangement of Nozzle Arrays:

FIG. 10 is an explanatory diagram illustrating nozzle arrangement on the lower surface of the printing head 28 according to a third example. The lower surface of the printing head 28 is provided with, in order of the advancing direction (the right side in FIG. 10) thereof at the forward motion of the printing head 28: the nozzle array M, the nozzle array Lc, the nozzle array K, the nozzle array Y, the nozzle array C, and the nozzle array Lm. An arrangement distance of the nozzles and an offset between the adjacent nozzle arrays are the same as those of FIG. 4 of the first example.

Figure 11:
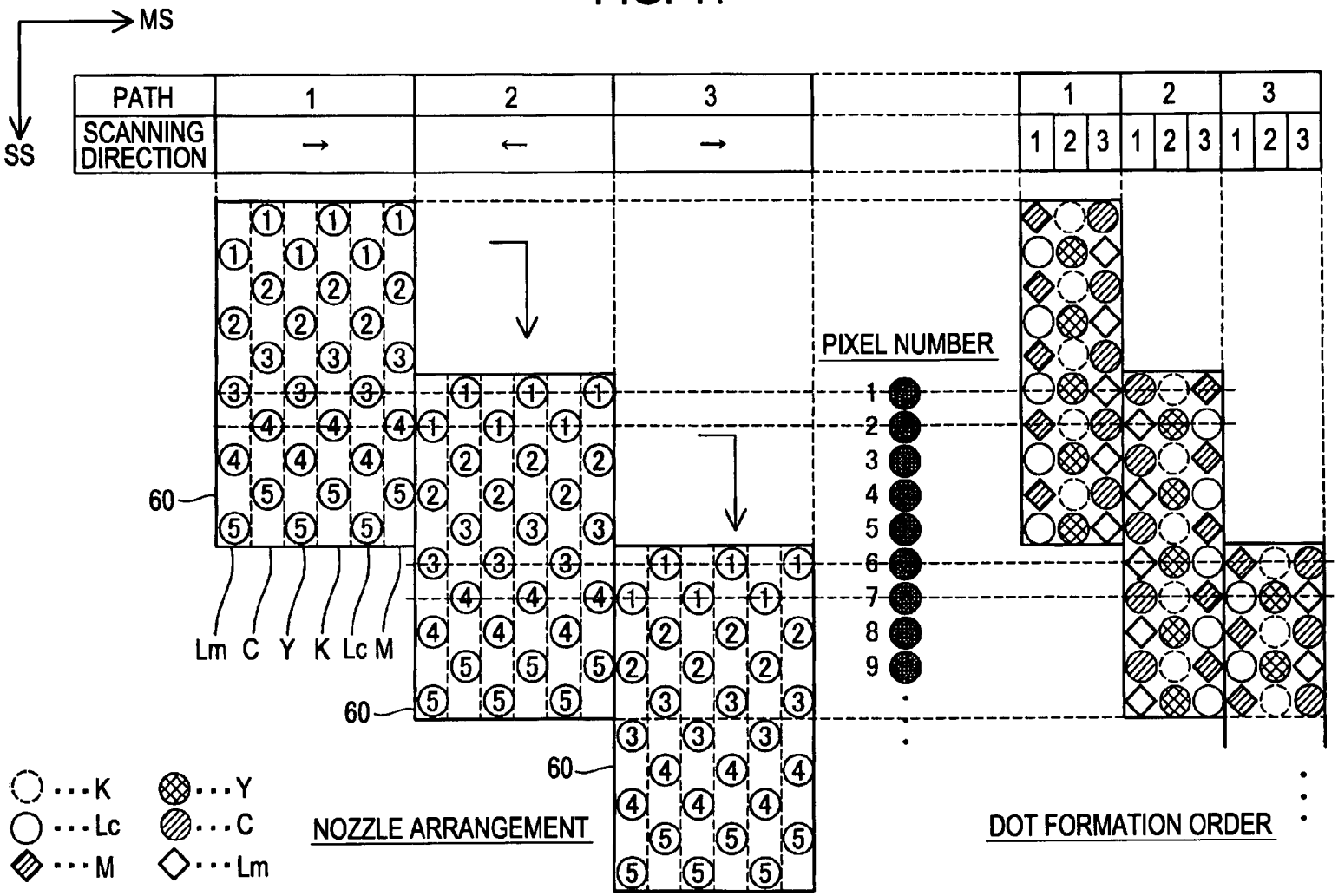
FIG. 11 is a diagram explaining a printing method according to the third example.

C2. Printing Method:

FIG. 11 is a diagram explaining a printing method according to the third example. Definition of the signs and marks in FIG. 11 is the same as those in FIG. 6. The printing head 28 forms dots in each pixel position in order of the nozzle array M, which is arranged downstream in an advancing direction (the right side in FIG. 1*l*) thereof, the nozzle array Lc, the nozzle array K, the nozzle array Y, the nozzle array C, and the nozzle array Lm, similarly to the first example.

The dot formation orders in the paths 1 and 2 of the printing head 28 will be described with reference to an example of pixels formed on positions of pixel Nos. 1 and 2. Dots of the light cyan ink, the yellow ink, the light magenta ink, the cyan ink, and the magenta ink are formed in this order, on the position of pixel No. 1. Dots of the magenta ink, the cyan ink, the light magenta ink, the yellow ink, and the light cyan ink are formed in this order, on the position of pixel No. 2. Dots are formed on the positions of pixel Nos. 3 and 5 in the same order as the position of pixel No. 1, thereby forming pixels thereon. Dots are formed on the position of pixel No. 4 in the same order as the position of pixel No. 2, thereby forming a pixel thereon.

Next, the dot formation orders of pixels printed in the paths 2 and 3 will be described with reference to an example of pixels formed on positions of pixel Nos. 6 and 7. Dots of the light magenta ink, the yellow ink, the light cyan ink, the magenta ink, and the cyan ink are formed in this order, on the position of pixel No. 6. Dots of the cyan ink, the magenta ink, the light cyan ink, the yellow ink, and the light magenta ink are formed in this order, on the position of pixel No. 7. Dots are formed on the positions of pixel Nos. 8 and 10 in the same order as the position of pixel No. 6, thereby forming pixels thereon. Dots are formed on the position of pixel No. 9 in the same order as the position of pixel No. 7, thereby forming a pixel thereon.

The dots of cyan-based inks and the dots of magenta-based inks are alternately formed, and the dots of yellow ink are formed between the dots of the cyan-based inks and the dots of the magenta-based inks, in each pixel printed by the printing head 28, similarly to the first example.

Next, printing orders of light and dark inks and the yellow ink will be described. In the first example, when the yellow ink is regarded as a reference, the cyan ink and the magenta ink as dark inks are printed in order of magenta ink->cyan ink->yellow ink, or in order of yellow ink->cyan ink->magenta ink, in the pixel formed in the paths 1 and 2, as shown in FIG. 11. In other words, the dark inks are printed in order of dark ink->dark ink->yellow ink, or in order of yellow ink->dark ink->dark ink, in the pixels formed in the paths 1 and 2. Likewise, the dark inks are printed in order of dark ink->dark ink->yellow ink, or in order of yellow ink->dark ink->dark ink, in the pixels formed in the paths 2 and 3.

By contrast, when the yellow ink is regarded as a reference, the light cyan ink and the light magenta ink as light inks are printed in order of light cyan ink->yellow ink->light magenta ink, or in order of light magenta ink->yellow ink->light cyan ink, in the pixel formed in the paths 1 and 2 as shown in FIG. 11. In other words, the light inks are printed in order of light ink->yellow ink->light ink, in the pixel formed in the paths 1 and 2. Likewise, light inks are printed in order of light ink->yellow ink->light ink, in the pixel formed in the paths 2 and 3.

As described above, the dark inks are printed before and after the yellow ink, and the light inks are successively printed before or after the yellow ink, in each pixel. In this manner, all the pixels are formed by printing the dark inks and the light inks with a good balance relative to the yellow ink, and thus it is possible to suppress color reversal and color unevenness.

D. Modified Example

Figure 12:
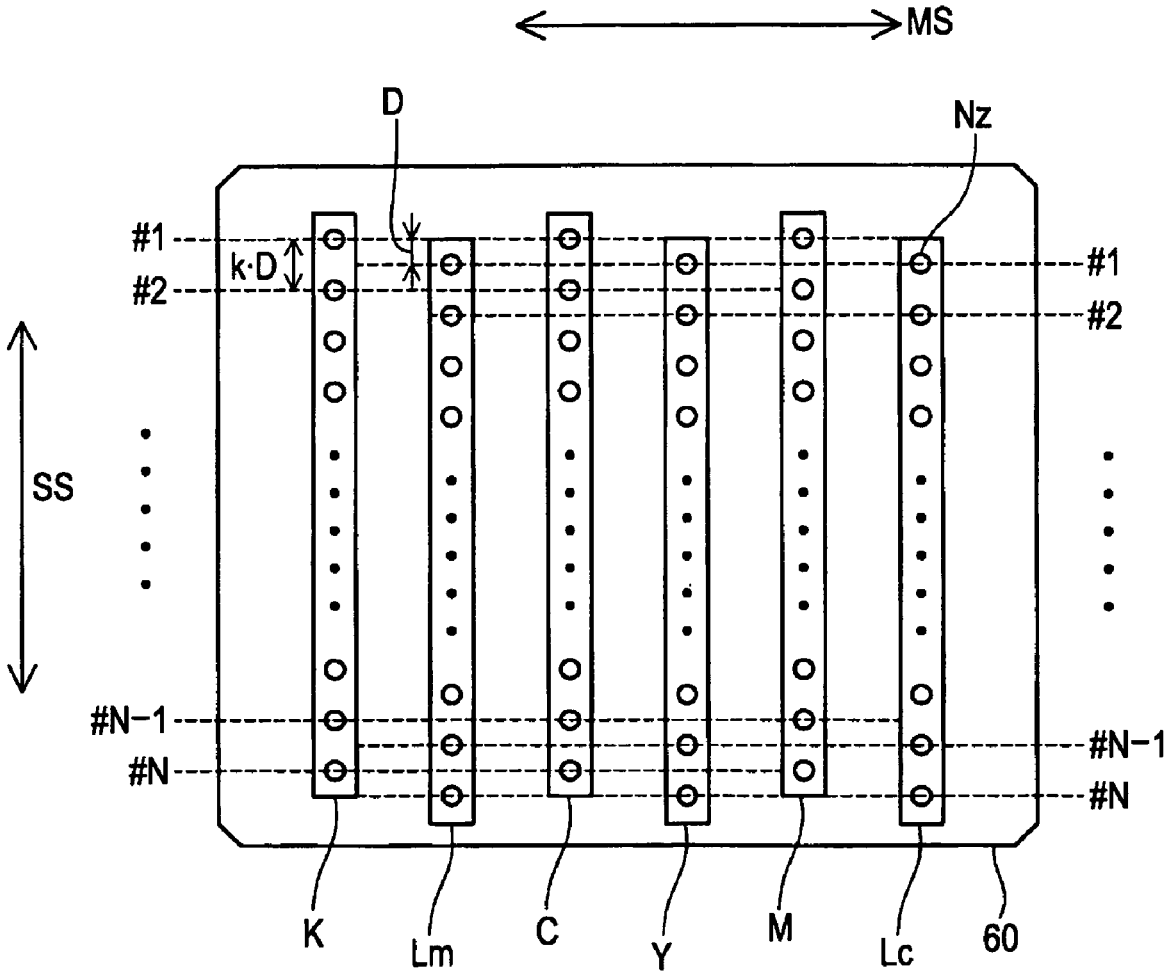
FIG. 12 is an explanatory diagram illustrating nozzle arrangement on the lower surface of the printing head 28 according to a modified example.

1. FIG. 12 is an explanatory diagram illustrating nozzle arrangement on the lower surface of the printing head 28 according to a modified example. The lower surface of the printing head 28 is provided with, in order of the advancing direction (the right side in FIG. 12) thereof at the forward motion of the printing head 28: the nozzle array Lc, the nozzle array M, the nozzle array Y, the nozzle array C, the nozzle array Lm, and the nozzle array K. An arrangement distance of the nozzles and an offset between the adjacent nozzle arrays are the same as those of FIG. 4 of the first example.

Figure 13:
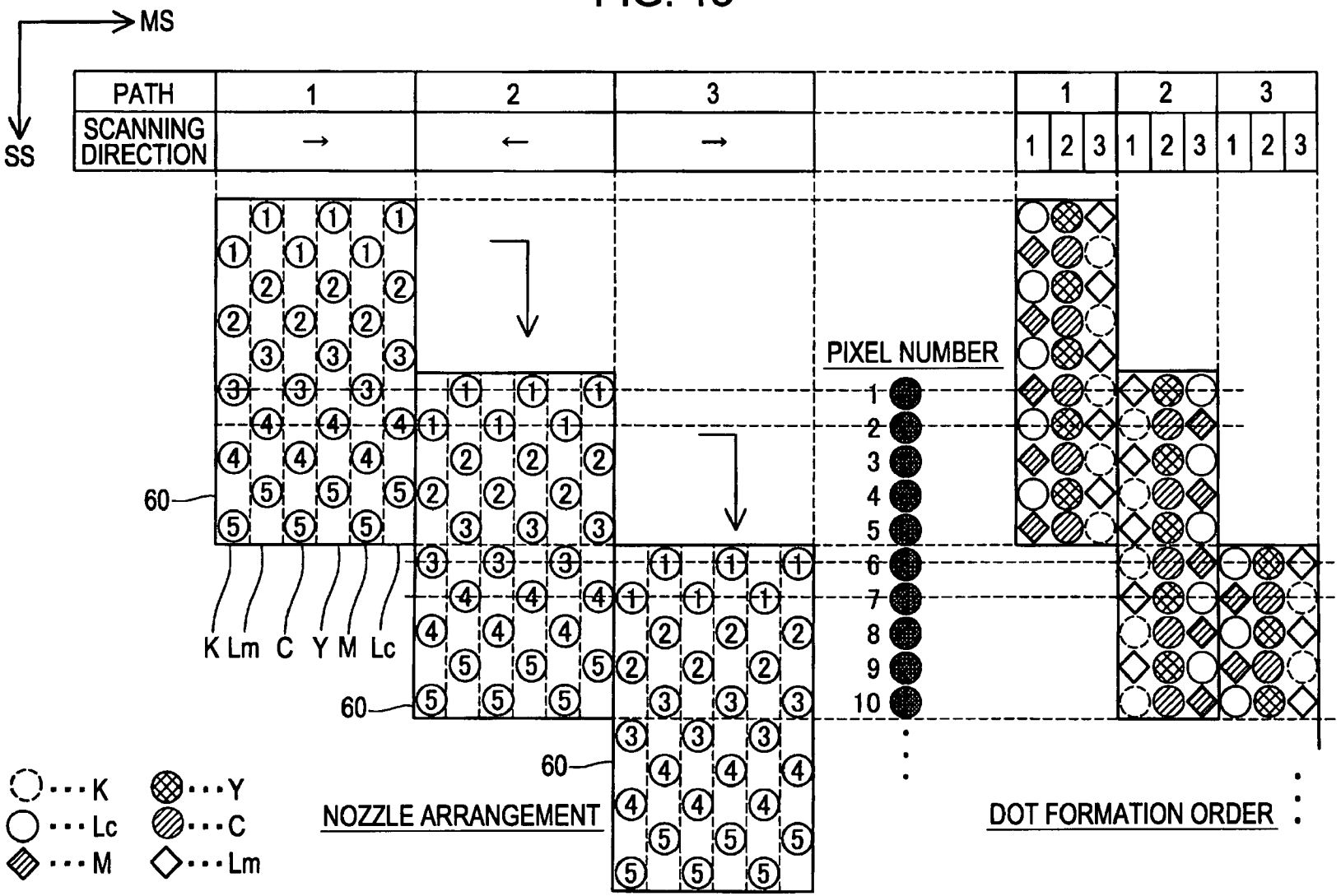
FIG. 13 is a diagram explaining a printing method according to the modified example.

FIG. 13 is a diagram explaining a printing method according to the modified example. Definition of the signs and marks in FIG. 13 is the same as those in FIG. 6. The printing head 28 forms dots in each pixel position in order of the nozzle arrays from the nozzles of the nozzle array arranged downstream in the advancing direction thereof at each of the forward and backward motions of the main scanning, similarly to the first example.

The dot formation orders in the paths 1 and 2 of the printing head 28 will be described. The dot formation order of the fourth example is the same as the dot formation order of the third example. The printing order of the-black ink K according to the fourth example is different from the printing order of the black ink K according to the third example. Specifically, the black ink K is printed between the cyan ink and the magenta ink in the third example, while the black ink K is printed before or after both of the cyan ink and the magenta ink are printed in the fourth example. However, since a new color is not created by mixing the black ink K with other color inks, dots of other colors may not be formed on the dot of the back ink K. Accordingly, there is actually no difference between the printing orders of the third example and the fourth example. By adopting such a configuration of nozzle array arrangement according to the above-mentioned modified example, it is possible to obtain the same advantages as the third example. An area in which the black ink K is used together with color inks such as a yellow ink Y, a magenta ink M, and a cyan ink C may exist in some color areas. In this case, since the color of the ink K is maintained regardless of the printing order of the ink K, the printing order of the black ink K have almost no influence on the color thereof.

2. In the above-mentioned examples, the nozzle arrays are alternately offset as the plurality of nozzles is arranged in a hound's-tooth form, but it is not necessary that the nozzle arrays are periodically offset, and the nozzle arrays may be randomly offset.

3. In the above-mentioned examples, nozzles are arranged in a hound's-tooth form, dots are ejected in order of nozzle array arrangement from the nozzles positioned first in the advancing direction of the printing head 28, and the printing paper is transported by one-half of the dot pitch at each path, thereby forming an image. However, it may be possible to adopt, for example, a configuration in which a pixel is formed by repeatedly scanning the printing head 28 on the same position in the sub-scanning direction. In this case, for example, one pixel is formed by the nozzles having the same nozzle number. By adopting such a configuration, all the pixels are formed by using the same dot formation order, and thus it is possible to suppress unevenness with high accuracy.

4. In the above-mentioned examples, the ink jet printer containing six color inks has been described, but for example, a pixel may be formed by allowing the ink jet printer, which contains inks of four colors such as cyan, magenta, yellow, and black, to form the yellow dot between the cyan and magenta dots.

As described above, the invention has been illustrated and described with respect to several examples thereof, but the invention is not limited to these examples, and may be modified in various forms without departing from the technical spirit thereof.

What is claimed is:

1. A liquid ejecting apparatus for forming a multicolored image on a recording medium, the liquid ejecting apparatus comprising:

a printing head that has at least a first nozzle array for ejecting a liquid of a first color having a first hue, a second nozzle array for ejecting a liquid of a second color having a second hue, and a third nozzle array for ejecting a liquid of a third color having a third hue;

a head driving section that performs a main scanning for moving the printing head in a main scanning direction;

a transporting section that transports the recording medium in a sub-scanning direction crossing the main scanning direction; and a dot control section that controls the head driving section and the transporting section so as to form an image on the recording medium by ejecting the liquids on the recording medium from the nozzle while repeatedly performing the main scanning for moving the printing head in the main scanning direction and a sub-scanning for transporting the recording medium in the sub-scanning direction, wherein the dot control section controls the printing head so as to alternately form a dot having the first hue and a dot having the second hue and form a dot having the third hue between the dot having the first hue and the dot having the second hue, when forming one predetermined pixel constituting the image.

2. The liquid ejecting apparatus according to claim 1, wherein the printing head further includes a fourth nozzle array for ejecting a liquid of a fourth color that has the first hue and is different from the first color, and a fifth nozzle array for ejecting a liquid of a fifth color that has the second hue and is different from the second color.

3. The liquid ejecting apparatus according to claim 2, wherein the fourth color is lighter than the first color, and the fifth color is lighter than the second color, and wherein the dot control section controls the printing head so as to successively form a dot of the fourth color and a dot of the fifth color, successively form a dot of the first color and a dot of the second color, and form a dot of the third color between the dot of the fourth color and the dot of the fifth color or between the dot of the first color and the dot of the second color, when forming the one predetermined pixel.

4. The liquid ejecting apparatus according to claim 2, wherein the printing head is configured such that the nozzle array of the first hue and the nozzle array of the second hue are alternately provided, the third nozzle array is disposed between the nozzle array of the first hue and the nozzle array of the second hue, and the plurality of nozzles are offset from each other by one-half of a predetermined distance in the sub-scanning direction so as to be arranged in a hound's-tooth form, and wherein the dot control section forms dots in order of the nozzle arrays from the nozzle array arranged downstream in an advancing direction of the printing head, during the main scanning.

5. The liquid ejecting apparatus according to claim 4, wherein the fourth color is lighter than the first color, and the fifth color is lighter than the second color, and wherein the printing head is configured such that nozzles of the fourth and fifth nozzle arrays are offset by one-half of the predetermined distance from nozzles of the first and second nozzle arrays, respectively.

6. The liquid ejecting apparatus according to claim 5, wherein the printing head is configured such that nozzles of the third nozzle array and the nozzles of the fourth and fifth nozzle arrays are offset by one-half of the predetermined distance from nozzles of the first and second nozzle arrays.

7. The liquid ejecting apparatus according to claim 1, wherein the first color is cyan, the second color is magenta, the third color is yellow, the fourth color is light cyan, and the fifth color is light magenta.

8. A liquid ejecting method for a liquid ejecting apparatus including: a printing head that has at least a first nozzle array for ejecting a liquid of a first color having a first hue, a second nozzle array for ejecting a liquid of a second color having a second hue, and a third nozzle array for ejecting a liquid of a third color having a third hue; a head driving section that performs a main scanning for moving the printing head in a main scanning direction; a transporting section that transports the recording medium in a sub-scanning direction crossing the main scanning direction; and a dot control section that controls the head driving section and the transporting section so as to form an image on the recording medium by ejecting the liquids on the recording medium from the nozzle while repeatedly performing the main scanning for moving the printing head in the main scanning direction and a sub-scanning for transporting the recording medium in the sub-scanning direction, the liquid ejecting method comprising:

forming alternately a dot having the first hue and a dot having the second hue, and forming a dot having the third hue between the dot having the first hue and the dot having the second hue, when forming one predetermined pixel constituting the image.

* * * * *